US009638409B2

(12) United States Patent
Kuriyama

(10) Patent No.: US 9,638,409 B2
(45) Date of Patent: May 2, 2017

(54) LED LAMP

(71) Applicant: MITSUBISHI CHEMICAL CORPORATION, Chiyoda-ku (JP)

(72) Inventor: Toshihiko Kuriyama, Yokohama (JP)

(73) Assignee: MITSUBISHI CHEMICAL CORPORATION, Chiyoda-ku (JP)

( * ) Notice: Subject to any disclaimer, the term of this patent is extended or adjusted under 35 U.S.C. 154(b) by 111 days.

(21) Appl. No.: 14/801,459

(22) Filed: Jul. 16, 2015

(65) Prior Publication Data

US 2015/0323169 A1 Nov. 12, 2015

Related U.S. Application Data

(63) Continuation of application No. PCT/JP2013/084076, filed on Dec. 19, 2013.

(30) Foreign Application Priority Data

Jan. 29, 2013 (JP) ..... 2013-014414

(51) Int. Cl.
*F21V 29/77* (2015.01)
*F21V 29/85* (2015.01)
(Continued)

(52) U.S. Cl.
CPC ..... *F21V 29/773* (2015.01); *F21K 9/233* (2016.08); *F21V 19/002* (2013.01);
(Continued)

(58) Field of Classification Search
CPC ..... F21V 29/773; F21V 29/713; F21V 29/85; F21V 19/002; F21V 29/00; F21V 29/10;
(Continued)

(56) References Cited

U.S. PATENT DOCUMENTS 7,658,511 B2 2/2010 Sugiyama et al.
7,918,587 B2 * 4/2011 Hsu ..... F21V 29/004 165/104.33
(Continued)

FOREIGN PATENT DOCUMENTS

JP 2004-528698 A 9/2004
JP 2006-502551 A 1/2006
(Continued)

OTHER PUBLICATIONS

International Preliminary Report on Patentability issued Aug. 13, 2015 in PCT/JP2013/084076 filed Dec. 19, 2013 (English translation only).
(Continued)

*Primary Examiner* — Bao Q Truong
(74) *Attorney, Agent, or Firm* — Oblon, McClelland, Maier & Neustadt, L.L.P.

(57) ABSTRACT

An LED lamp comprising: an LED light-emitting module including an LED; an lens module provided in front of the LED light-emitting module; a casing accommodating the LED light-emitting module and having a sectional area decreasing toward a base located on a back portion of the LED lamp; and a heat sink configuring at least part of the casing and dissipating heat emitted by the LED.

14 Claims, 12 Drawing Sheets

(51) Int. Cl.

| | |
|---|---|
| ***F21V 19/00*** | (2006.01) |
| ***F21V 29/71*** | (2015.01) |
| ***F21K 9/233*** | (2016.01) |
| *F21Y 101/00* | (2016.01) |

(52) U.S. Cl.
CPC ..... *F21V 29/713* (2015.01); *F21V 29/85* (2015.01); *F21Y 2101/00* (2013.01)

(58) Field of Classification Search
CPC ..... F21V 29/503; F21V 29/70; F21V 29/02; F21V 29/74; F21V 29/76; F21V 29/763; F21V 29/2212; F21V 29/71; F21K 9/233; F21Y 2101/00; H01L 33/64
See application file for complete search history.

(56) References Cited

U.S. PATENT DOCUMENTS

| | | | | |
|---|---|---|---|---|
| 8,053,959 | B2 * | 11/2011 | Lai | F21V 29/773 313/318.01 |
| 9,097,393 | B2 * | 8/2015 | Huang | F21K 9/1355 |
| 2002/0176250 | A1 | 11/2002 | Bohler et al. | |
| 2004/0066142 | A1 | 4/2004 | Stimac et al. | |
| 2011/0057551 | A1 | 3/2011 | Lee et al. | |
| 2011/0198979 | A1 | 8/2011 | Shum et al. | |
| 2012/0098403 | A1 | 4/2012 | Lee et al. | |
| 2012/0268941 | A1 | 10/2012 | Shih et al. | |
| 2013/0058110 | A1 | 3/2013 | Chen et al. | |
| 2015/0055354 | A1 * | 2/2015 | Mueller | F21K 9/23 362/373 |

FOREIGN PATENT DOCUMENTS

| | | | |
|---|---|---|---|
| JP | 2011-060754 | A | 3/2011 |
| JP | 3166364 | U | 3/2011 |
| JP | 3168429 | U | 6/2011 |
| JP | 3176995 | U | 7/2012 |
| JP | 2012-169274 | A | 9/2012 |

OTHER PUBLICATIONS

English Translation of the International Search Report issued Feb. 25, 2014 in PCT/JP2013/084076 filed Dec. 19, 2013.

* cited by examiner

LED LAMP

CROSS-REFERENCE TO RELATED APPLICATIONS

This is a continuation of International Application PCT/JP2013/084076, filed on Dec. 19, 2013, and designated the U.S., (and claims priority from Japanese Patent Application 2013-14414 which was filed on Jan. 29, 2013,) the entire contents of which are incorporated herein by reference.

TECHNICAL FIELD

The present invention relates to a lamp using an LED.

BACKGROUND ART

There have been developed various LED lamps using a semiconductor light-emitting element such as an LED (Light-emitting Diode), and having high efficiency and a long life, instead of a general lighting fixture such as a halogen bulb. There are problems that when an LED becomes a high temperature because of heat generated by the LED, light-emitting efficiency decreases and thus light output of a lamp decreases and life of the LED becomes short. Therefore, there has been known that the LED lamp of this type includes a heat sink that dissipates heat emitted from the LED (see Patent documents 1 to 4).

CITATION LIST

Patent Document

[Patent document 1] National Publication of International Patent Application No. 2006-502551

[Patent document 2] National Publication of International Patent Application No. 2004-528698

[Patent document 3] Japanese Patent Laid-Open No. 2011-60754

[Patent document 4] Japanese Patent Laid-Open No. 2012-169274

SUMMARY OF INVENTION

Problems to be Solved by the Invention

A standard (for example, C7527-JIS-6320-2) defining a maximum outside diameter, a full length and the like is established in a general lighting fixture such as a halogen bulb. Accordingly, even in the case where the halogen bulb is replaced with an LED lamp, it is necessary that a maximum outside diameter, a full length and the like of the LED lamp meet the existing standard and thus providing a large heat sink is difficult. Therefore, in the case where the halogen bulb is replaced with the LED lamp, heat emitted from an LED cannot be fully dissipated and thus the LED becomes a high temperature, which may decreases light-emitting efficiency.

The present invention has been made in view of the above problems and an object thereof is to provide an LED lamp that can effectively prevent decrease of light-emitting efficiency even in the case where the LED lamp meets an existing standard.

Means for Solving the Problems

In order to solve the above problems, an LED lamp according to the present invention adopts the following means. That is, the LED lamp according to the present invention includes: an LED light-emitting module including an LED; and a casing accommodating the LED light-emitting module and having a sectional area decreasing toward a base. At least part of the casing includes a heat sink dissipating heat emitted by the LED, and the heat sink includes a bottom on which the LED light-emitting module is installed, a plurality of heat dissipation fins each having a plate shape, arranged on an outer circumference edge of the bottom and extending in forward and lateral directions of the bottom, and a heat dissipation body having a plate shape and provided to cover the casing such that it covers an area of 10% or more to 40% or less of an outermost diameter of the casing from the outermost diameter of the casing toward the bottom when the casing is viewed from a base side.

With the above configuration, both heat dissipation by convection and heat dissipation by heat radiation, which are generated by the plurality of heat dissipation fins and the heat dissipation body, can be maximized. Further, the convection in one direction and the stable convection can be achieved. Accordingly, the heat emitted from the LED can be fully dissipated, and the LED can be effectively prevented from becoming a high temperature.

Herein, in the LED lamp according to the present invention, a treatment for improving a heat radiation rate may be applied to each of the bottom, the heat dissipation fins, and the heat dissipation body of the heat sink. As the treatment for improving the heat radiation rate, there are various methods, such as a method of applying a surface treatment to each of the bottom, the heat dissipation fins, and the heat dissipation body of the heat sink to improve the heat radiation rate, a method of coating and forming a heat radiation rate improving film on each of the bottom, the heat dissipation fins, and the heat dissipation body of the heat sink, and a method of forming the heat radiation rate improving film on each of the bottom, the heat dissipation fins, and the heat dissipation body of the heat sink by soaking them in a heat radiation rate improving liquid. In this manner, by applying the treatment for improving the heat radiation rate to each of the bottom, the heat dissipation fins, and the heat dissipation body of the heat sink, the heat dissipation by the heat radiation from the plurality of heat dissipation fins and the heat dissipation body can be further improved.

Further, in the LED lamp according to the present invention, the heat dissipation body of the heat sink may be different from the bottom and the heat dissipation fins in the heat radiation rate. For example, it is conceivable that the treatment for improving the heat radiation rate is applied to only the heat dissipation body of the heat sink and is not applied to the bottom and the heat dissipation fins of the heat sink. In this manner, by applying the treatment for improving the heat radiation rate to only the heat dissipation body of the heat sink, the treatment for improving the heat radiation rate can be reduced, and the heat dissipation by the heat radiation from the heat dissipation body can be further improved.

Further, in the LED lamp according to the present invention, a surface area of the heat dissipation body may be larger than a surface area of the heat dissipation body in the case where the heat dissipation body is along an outer shape of the casing. For example, the heat dissipation body may have a recess and a projection in a thickness direction, may be entered into gaps between the heat dissipation fins, or may be configured to be wavelike toward the outward direction at predetermined intervals. In this manner, by making the surface area of the heat dissipation body larger than that in the case where the heat dissipation body is along the outer shape of the casing, the surface area of the heat dissipation body can be larger, and the heat dissipation by the heat radiation from the heat dissipation body can be further improved.

Further, in the LED lamp according to the present invention, the bottom may have a substantially circular shape, and the plurality of heat dissipation fins may be arranged radially on the outer circumference edge of the bottom. Further, the plurality of heat dissipation fins may be arranged at fixed intervals on the outer circumference edge of the bottom. Thereby, the heat dissipation by the convection generated by the plurality of heat dissipation fins can be further improved.

Further, in the LED lamp according to the present invention, in the LED light-emitting module, the LED may be mounted on a substantial center of a board to be disposed such that an optical axis of the LED and a center of the bottom substantially correspond with each other. As described above, by adopting the LED light-emitting module of a so-called one-core type, the point light source can be achieved in the LED lamp as a whole. In this manner, by downsizing the LED light-emitting module, the plurality of heat dissipation fins can be larger and the heat dissipation by the convection and the heat dissipation by the heat radiation, which are generated by the plurality of heat dissipation fins, can be further improved. Further, by adopting the LED light-emitting module of the so-called one-core type, multiple shadows can be effectively eliminated or reduced.

Further, the LED chip of the LED may include a GaN substrate. Thereby, even if a current density of the LED is increased, a defect is not easily generated. As a result, larger electric power for driving can be supplied to the LED and the LED lamp can emit light having larger luminous flux and illuminance.

Note that the means for solving the problems of the present invention can be combined with each other as much as possible.

Effects of the Invention

According to the present invention, in an LED lamp in which an LED is used as a light source, it is possible to provide an LED lamp that can effectively prevent decrease of light-emitting efficiency even in the case where the LED lamp meets an existing standard.

DESCRIPTION OF EMBODIMENT

With reference to the drawings, hereinafter, an embodiment will be described exemplarily and in detail. Note that, dimensions, materials, shapes, and relative positions of constituent elements to be described in this embodiment does not limit a technical range of the present invention to them unless description is specifically given.

<Overall Configuration of LED Lamp According to this Embodiment>

An LED lamp according to this embodiment is an LED lighting fixture including as its light source a light-emitting diode (hereinafter referred to as "LED"), and a casing thereof is configured to meet a standard size defined by standards such as JIS (Japanese Industrial Standards). Herein, referring to FIG. 1 to FIG. 5, description will be given of an example in which the LED lamp according to this embodiment is configured as an MR16 LED lighting fixture 1 replaceable with an MR16 halogen bulb having an outside diameter of about 50 mm. Note that, the MR16 halogen bulb, which meets the existing standard, has a substantially hemispherical shape such that a sectional area thereof decreases toward a base, and similarly, the MR16 LED lighting fixture 1 has a substantially hemispherical shape such that a sectional area thereof decreases toward a base.

Figure 1:
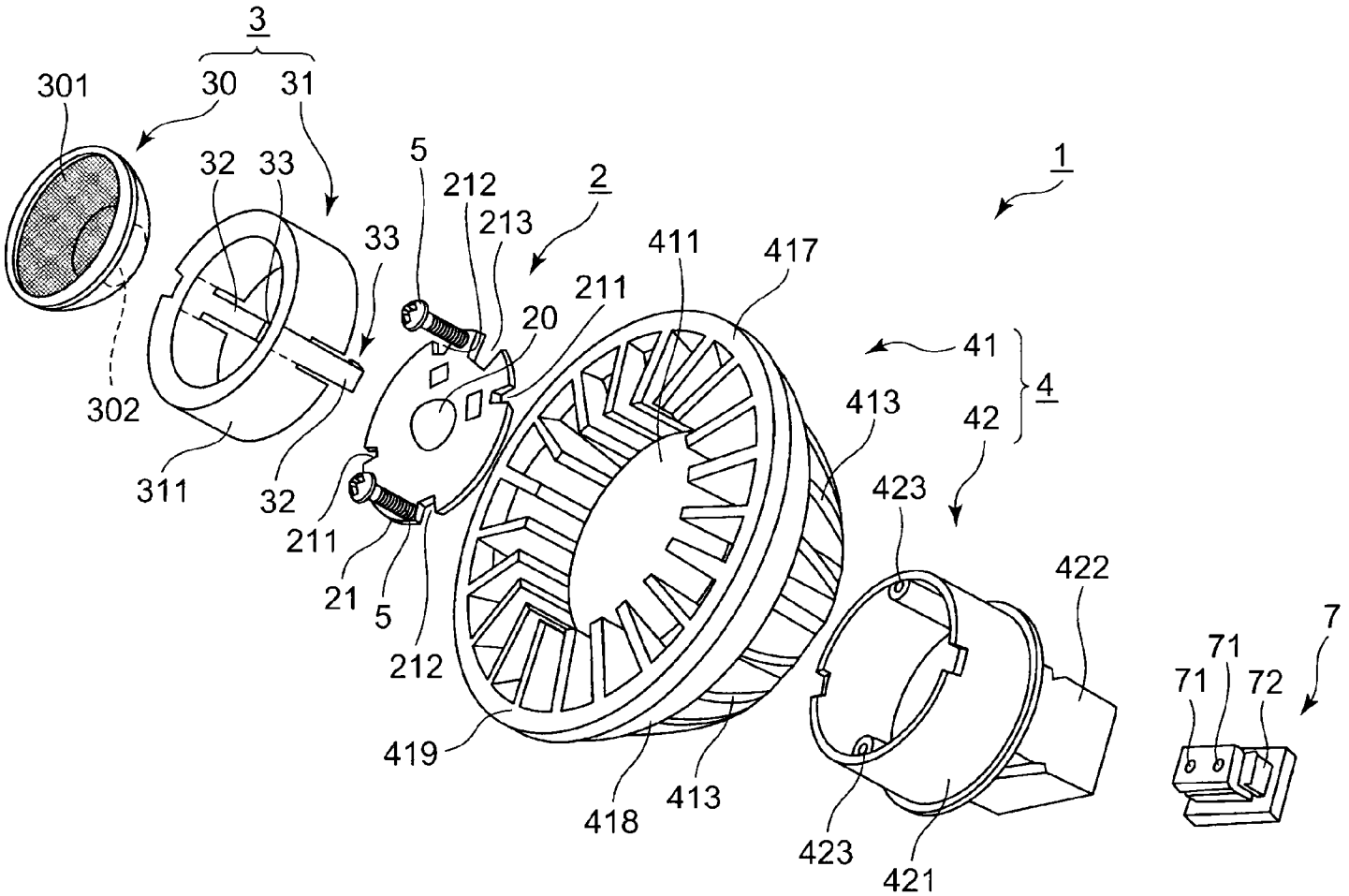
FIG. 1 is an exploded perspective view of an MR16 LED lighting fixture according to this embodiment.
Figure 2:
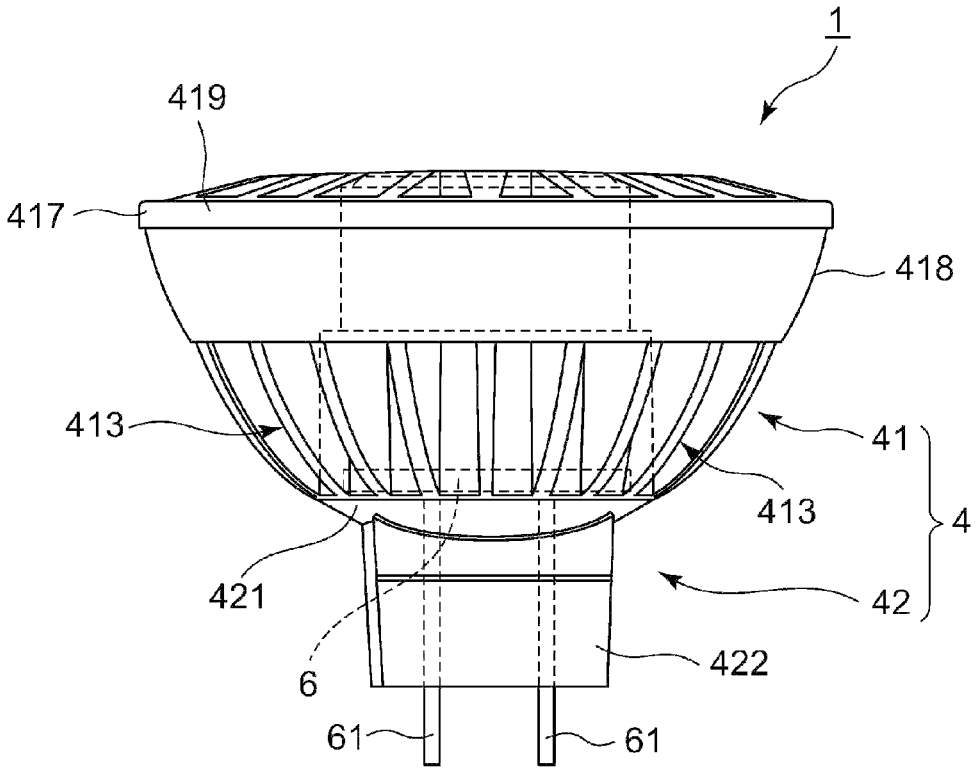
FIG. 2 is a side view of the MR16 LED lighting fixture according to this embodiment.
Figure 3:
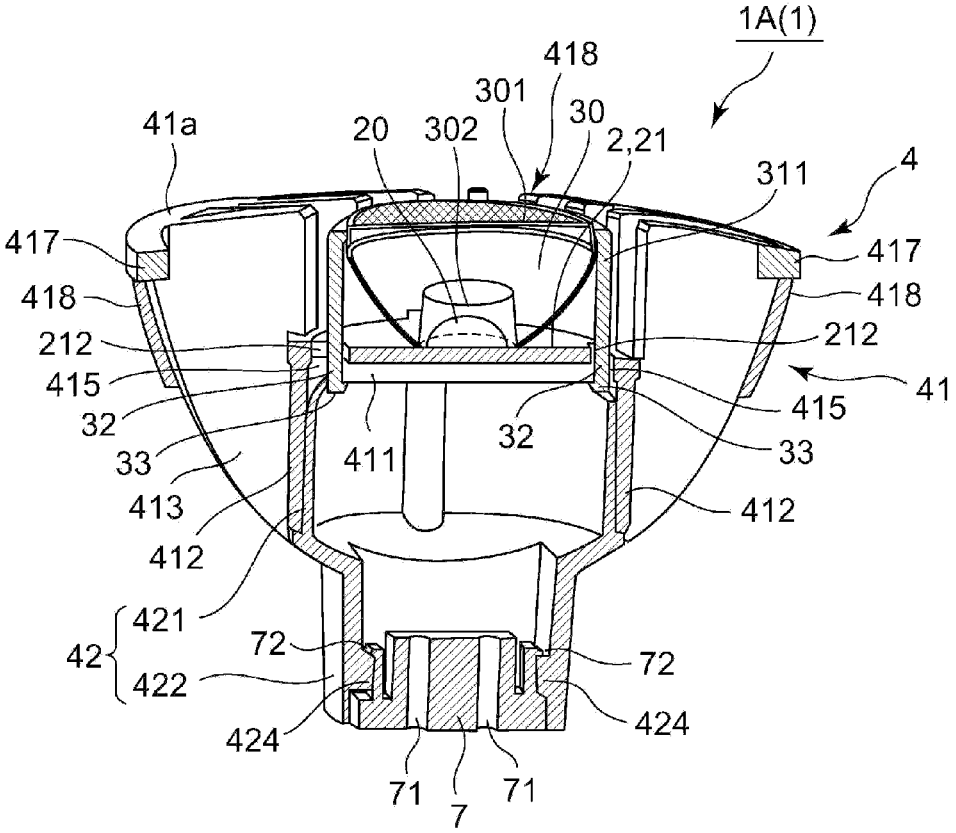
FIG. 3 is a perspective sectional view of the MR16 LED lighting fixture according to this embodiment.

FIG. 1 is an exploded perspective view of the MR16 LED lighting fixture 1 according to this embodiment. FIG. 2 is a side view of the MR16 LED lighting fixture 1 according to this embodiment. FIG. 3 is a perspective sectional view of the MR16 LED lighting fixture 1 according to this embodiment.

The MR16 LED lighting fixture 1 includes an LED light-emitting module 2, a lens module 3, and a casing 4. In this description, a side where the lens module 3 is provided is defined as a "front" of the LED lamp (MR16 LED lighting fixture 1).

The LED light-emitting module 2 includes an LED 20 as a light source and a module board 21 on which the LED 20 is mounted, and is a one-core type module in which the LED 20 is concentratedly disposed on a center of the module board 21. The module board 21 is, for example, a metal-based board made of a metallic material having high thermal conductivity, such as aluminum, or made of an insulating material.

The LED 20 has, for example, a chip-on-board structure in which one or a plurality of near ultraviolet LED chips is directly mounted on wiring provided on a mounting surface of the module board 21, and is configured by potting and the like with a light transmissive resin into which a blue phosphor, green phosphor, and red phosphor are mixed, the blue phosphor, green phosphor, and red phosphor being excited with the near ultraviolet LED chip to emit light. Note that, the LED chip is not limited to the near ultraviolet LED chip and various LED chips such as a blue LED chip can be used, and depending on the used LED chip, various phosphors can be selected. Further, the LED chip in this embodiment, includes a GaN substrate. In the case where the LED chip including the GaN substrate is used, large current can be applied and thus a point light source having high luminous flux can be achieved.

Note that the LED 20 can adopt a package structure instead of the chip-on-board structure, and can be applied to various forms. Further, in the LED light-emitting module 2, the plurality of LEDs 20 may be disposed in a dispersed manner on the module board 21. In the LED chip, a substrate other than the GaN substrate, for example, a sapphire substrate, or a silicon substrate may be applied.

The lens module 3 includes a lens 30 and a lens holder 31 to which the lens 30 can be attached. The lens 30 is a lens having a predetermined light distribution angle. Further, the lens 30 is, for example, made of an acrylic resin, a polycarbonate resin or the like, and for example, has a substantially truncated conical shape as a whole. The lens 30 includes a light emission surface 301 that emits light produced by the LED 20. In the lens 30, when a side where the light emission surface 301 is formed is defined as a "front portion", a recess 302 for accommodating the LED 20 is formed on a back portion of the lens 30.

The light emission surface 301 of the lens 30 is, for example, a collimator lens. Further, a bottom of the recess 302 in the lens 30 is, for example, provided with a convex lens convex toward the back portion. The light emission surface 301 is not limited to the collimator lens, and various lenses, such as a fresnel lens can preferably be used. Further, as illustrated in FIG. 3, the lens 30 is provided at a position facing the LED 20 mounted on the module board 21 and accommodates the LED 20 in the recess 302, thereby preventing interference between the lens 30 and the LED 20. Note that the shape, size, material and the like of the lens 30 can be changed appropriately.

The lens holder 31 includes a holder body 311 that can hold the lens 30 thereinside and that have a substantially cylindrical shape. An inside diameter of the holder body 311 is equal to an outside diameter of the lens 30. The lens 30 is fitted into the holder body 311, so that the lens holder 31 can hold the lens 30. The lens holder 31 has light transmission property, and, for example, is made of a transparent resin. The lens holder 31 further includes a pair of protrusion arms 32 each protruding downward from the holder body 311. Further, an end of the protrusion arm 32 is formed with a hooklike connection claw 33.

The casing 4 is a casing (housing) of the MR16 LED lighting fixture 1, and accommodates the LED light-emitting module 2, the lens module 3 and the like. Further, at least part of the casing 4 includes a heat sink that dissipates heat emitted by the LED 20. Specifically, the casing 4 includes the heat sink 41 that dissipates the heat emitted by the LED 20, a driver housing 42 that accommodates a circuit board for a power source 6 (see FIG. 2) supplying electric power for driving to the LED 20 in the LED light-emitting module 2 from the power source.

As a material of the driver housing 42, various resins, an inorganic material such as ceramics, or metal such as aluminum can be applied, or these materials may be combined with each other to configure the driver housing 42. In this embodiment, PBT (polybutylene terephthalate) is used for the driver housing 42, but the driver housing 42 is not limited to the PBT. Further, the driver housing 42 is preferably made of a resin material not having conductivity. The driver housing 42 includes a board accommodation part 421 that accommodates the circuit board 6 and a lead press attachment part 422 provided in a coupled manner on a back of the board accommodation part 421. The board accommodation part 421 includes a pair of fixing parts 423 with which fasteners such as screws can be screwed.

A lead press member 7 is attached to the lead press attachment part 422 of the driver housing 42. The lead press member 7 is an insulating member. A pair of pin insertion holes 71 are drilled on the lead press member 7 in its thickness direction. Base pins 61 (see FIG. 2) of the base provided on the circuit board 6 (see FIG. 2) are inserted into the insertion holes 71. Further, the lead press member 7 includes locking claws 72 that are locked with locking parts 424 provided on the lead press attachment part 422 of the driver housing 42.

Figure 4:
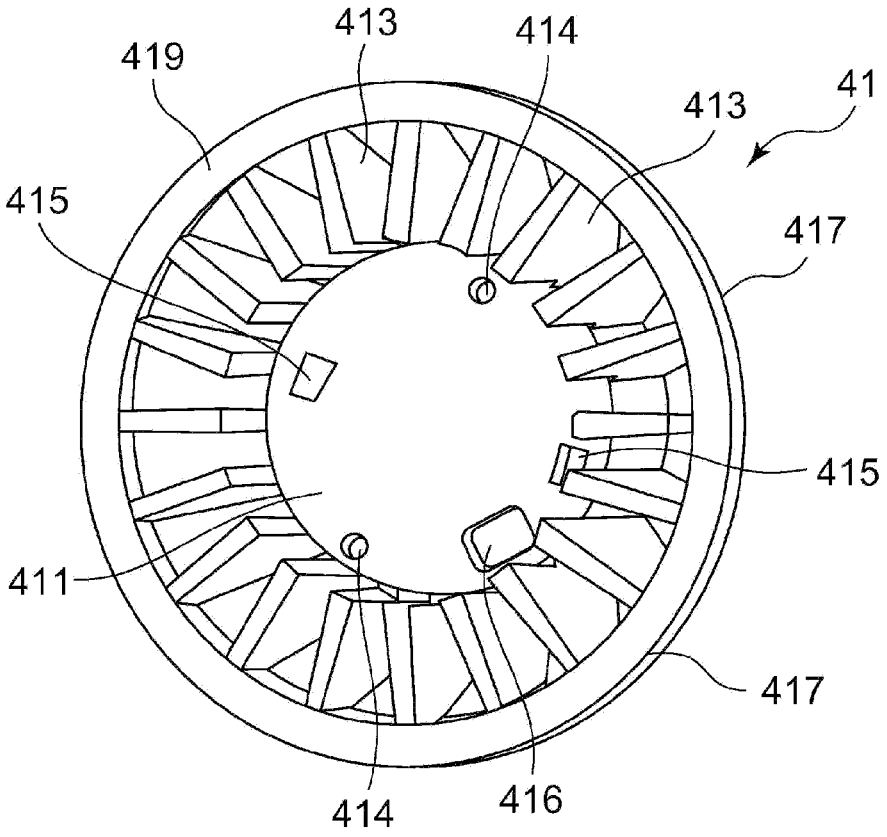
FIG. 4 is a perspective view of a heat sink according to this embodiment.
Figure 5:
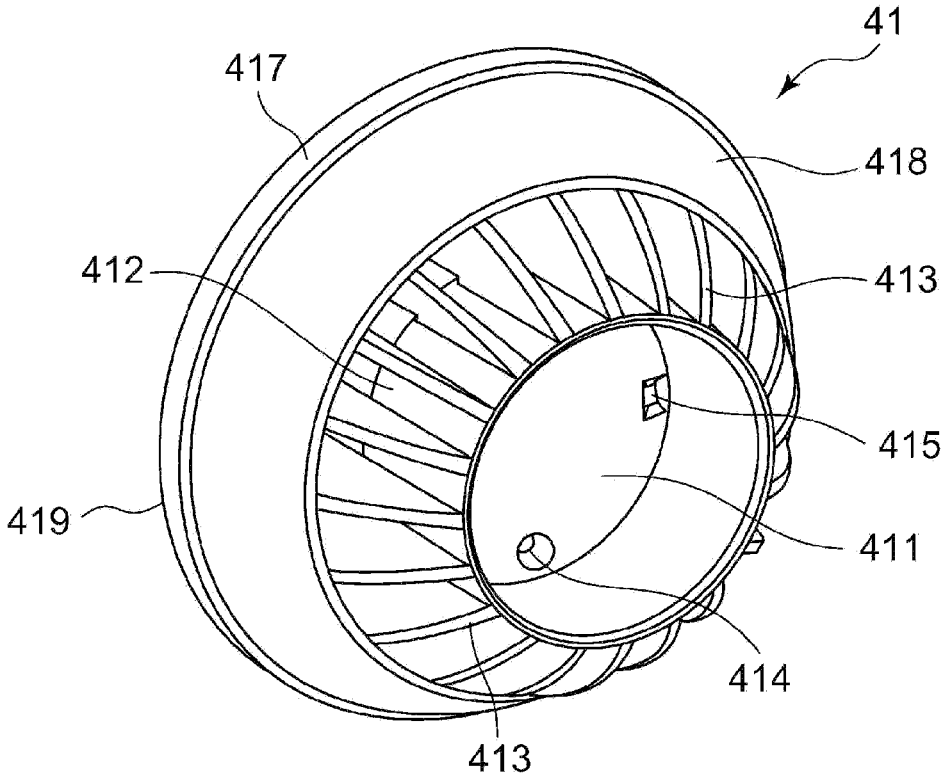
FIG. 5 is a perspective view of the heat sink according to this embodiment.

FIG. 4 and FIG. 5 each are a perspective view of the heat sink 41 according to this embodiment. The heat sink 41 is a housing member configuring the casing 4 together with the driver housing 42. Further, the heat sink 41 is a heat dissipation member for dissipating the heat emitted by the LED 20 as described above. The heat sink 41 is a member having high thermal conductivity, and for example, made of aluminum or the like.

The heat sink 41 includes an installation part 411 for installing the LED light-emitting module 2 and the lens module 3, an outer cylinder part 412 located on a back of the installation part 411, and a plurality of heat dissipation fins 413 provided on a circumference of the outer cylinder part 412.

The installation part 411 of the heat sink 41 has a substantially circular plane shape. Further, the board accommodation part 421 of the driver housing 42 can be inserted into the outer cylinder part 412. A pair of screw insertion holes 414 and a pair of arm insertion holes 415, into which the pair of protrusion arms 32 in the holder body 311 of the lens holder 31 can be inserted respectively, are formed on the installation part 411 of the heat sink 41. The installation part 411 of the heat sink 41 is formed with an opening for wiring 416, through which the wiring is connected to respective terminals of the circuit board 6 and the module board 21 accommodated in the driver housing 42.

Further, in the heat sink 41, the plurality of heat dissipation fins 413 is arranged radially on an outer circumference edge of the installation part 411. Each of the plurality of heat dissipation fins 413 has a plate shape, and a surface area of the heat sink 41 increases, so that dissipation of heat transferred from the LED 20 to the installation part 411 can be promoted. Each of the heat dissipation fins 413 is connected to an outer surface of the outer cylinder part 412 and extends radially toward a lateral exterior of the outer cylinder part 412 (in other words, toward a lateral exterior of the installation part 411). Further, the heat dissipation fins 413 are disposed radially at fixed intervals from a center of the installation part 411 in the heat sink 41. The heat dissipation fins 413 extend forward from the installation part 411 in the heat sink 41, and ends of the heat dissipation fins 413 are connected to each other with an annular rim 417.

<Assembly of MR16 LED Lighting Fixture 1>

As illustrated in FIG. 1 and FIG. 3, the LED light-emitting module 2 and the lens module 3 are installed on the installation part 411 of the heat sink 41. Specifically, the LED light-emitting module 2 is fixed to the casing 4 with fixing screws 5. On the module board 21 of the LED light-emitting module 2, there are formed a pair of screw insertion parts 211, which are cutouts and into which the fixing screws 5 are inserted, and a pair of arm insertion parts 212, which are cutouts and into which the protrusion arms 32 in the holder body 311 of the lens holder 31 are inserted. Further, on the module board 21, there is formed a cutout part for wiring 213, which is a cutout through which the wiring is connected to the respective terminals of the circuit board 6 and the module board 21 accommodated in the driver housing 42 (see FIG. 1).

When the MR16 LED lighting fixture 1 is assembled, the fixing screw 5 is sequentially inserted into the screw insertion part 211 formed on the module board 21 and the screw insertion hole 414 formed on the installation part 411 of the heat sink 41, and then screwed with a screw groove formed on the fixing part 423 provided on the board accommodation part 421 in the driver housing 42. Thereby, the LED light-emitting module 2 is fixed to the installation part 411 of the heat sink 41 with the fixing screws 5, and also the heat sink 41 and the driver housing 42 are connected.

Meanwhile, the lens module 3 is fixed to the heat sink 41 with the connection claws 33 formed on the ends of the protrusion arms 32 in the lens holder 31. Specifically, the protrusion arms 32 in the lens holder 31 are inserted into the arm insertion parts 212 formed on the module board 21 and the arm insertion holes 415 formed on the installation part 411 of the heat sink 41, and then the connection claws 33 formed on the ends of the protrusion arms 32 are hooked to the back of the installation part 411. Thereby, the lens module 3 is attached to the heat sink 41 while holding the LED light-emitting module 2. Further, the connection claws 33 of the protrusion arms 32 are provided to face a center direction (that is, inside) of the installation part 411 of the heat sink 41, and locked with the arm insertion holes 415 formed on the installation part 411 of the heat sink 41.

Further, when the MR16 LED lighting fixture 1 is assembled, the circuit board 6 (see FIG. 2) is accommodated in the board accommodation part 421 of the driver housing 42, and the base pins 61 (see FIG. 2) are inserted into the pin insertion holes 71 of the lead press member 7. Then, the locking claws 72 of the lead press member 7 are hooked to the locking parts 424 of the lead press attachment part 422, so that the lead press member 7 can be attached to the driver housing 42. Note that the base pins 61 protruding outside through the pin insertion holes 71 of the lead press member 7 can be fitted into and connected to a socket (not illustrated). Thereby, electric power can be supplied to the circuit board 6 from the external power source.

The wiring from the circuit board 6 accommodated in the driver housing 42 can be guided to the mounting surface of the LED 20 in the module board 21 through the opening for wiring 416 formed on the installation part 411 of the heat sink 41 and the cutout part for wiring 213 formed on the module board 21, and connected to the terminal provided on the mounting surface of the LED 20. Thereby, the electric power for driving from the circuit board 6 can be supplied to the LED 20 mounted on the module board 21.

<Characteristic Configuration of Heat Sink According to this Embodiment>

Figure 6:
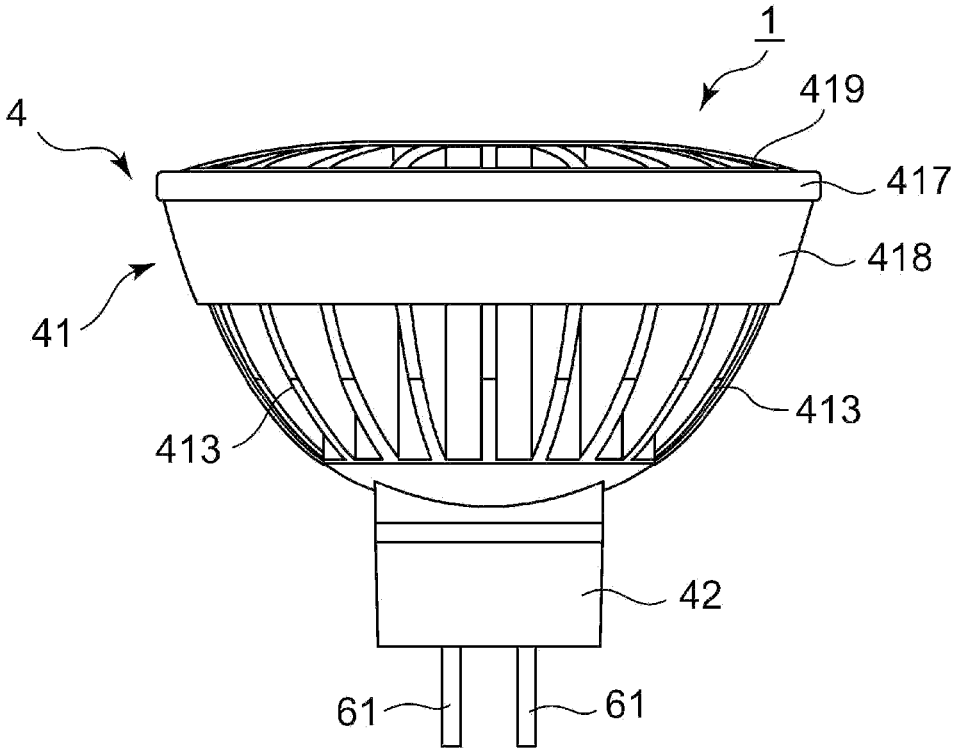
FIG. 6 is a side view of the MR16 LED lighting fixture according to this embodiment.
Figure 7:
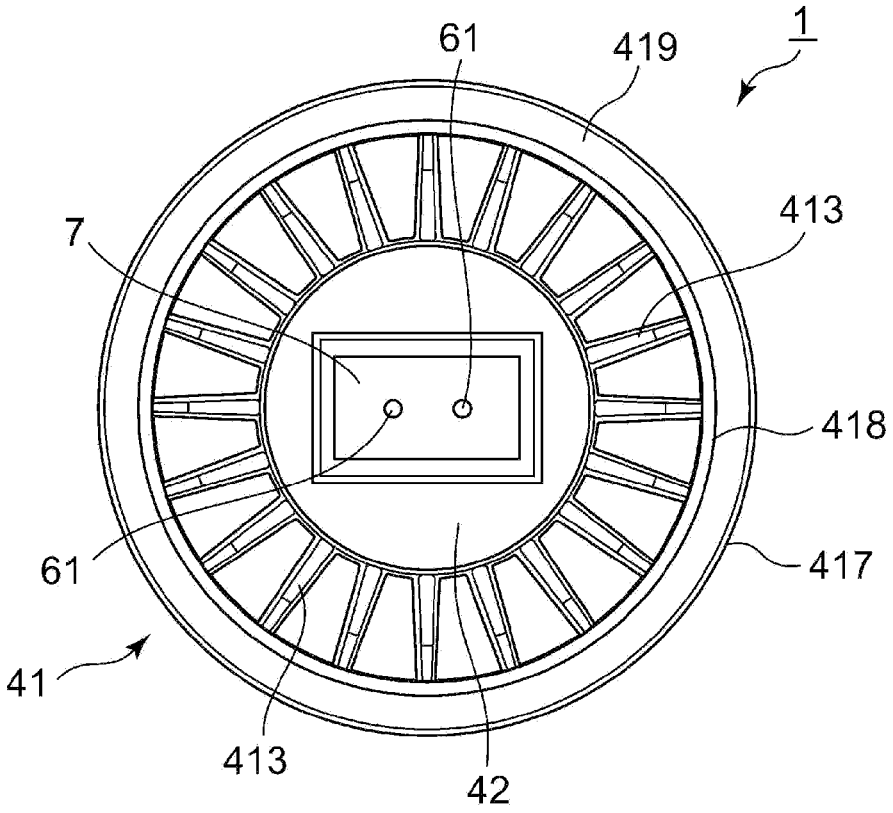
FIG. 7 is a top view of the MR16 LED lighting fixture according to this embodiment.

FIG. 6 is a side view of the MR16 LED lighting fixture 1 according to this embodiment. FIG. 7 is a top view of the MR16 LED lighting fixture 1 according to this embodiment. As described above, the MR16 LED lighting fixture 1 according to this embodiment has the substantially hemispherical shape such that the sectional area thereof decreases toward the base. Further, in the MR16 LED lighting fixture 1 according to this embodiment, at least part of the casing 4 includes the heat sink 41 that dissipates the heat emitted by the LED 20, and the heat sink 41 include the bottom 411 on which the LED light-emitting module 2 is installed, and the plurality of heat dissipation fins 413 each having the plate shape, arranged on the outer circumference edge of the bottom 411 and extending in forward and lateral directions of the bottom 411.

In addition to this, as the characteristic configuration, the heat sink 41 in the MR16 LED lighting fixture 1 according to this embodiment is provided with a heat dissipation body 418 configured to be a beltlike shape having continuity and having a plate shape of a predetermined thickness. Note that the heat dissipation body 418 is not limited to the beltlike shape having the continuity, and for example may have one or a plurality of slits at predetermined positions without having the continuity.

In this case, the heat dissipation body 418 is a heat dissipation member for dissipating the heat emitted by the LED 20 like the heat sink 41. The heat dissipation body 418 is a member having high thermal conductivity, and, for example, made of aluminum or the like. Further, the heat dissipation body 418 connects portions on the outer circumference side of the heat dissipation fins 413 to each other, and radiates heat toward the outside of the casing 4. Therefore, the heat incident again is decreased, so that efficiency of the heat radiation can be improved. Note that the heat dissipation body 418 may be formed integrally with the heat sink 41, or may be formed as a separate member.

The heat dissipation body 418 is in contact with the annular rim 417, and is provided to have a predetermined height from the annular rim 417 toward a base pins 61 side as illustrated in FIG. 6. That is, the heat dissipation body 418 is provided to cover a predetermined area of the casing 4 from an outermost diameter of the casing 4 toward the bottom 411 (base pins 61 side) as illustrated in FIG. 7.

An outermost diameter of the MR16 LED lighting fixture is about 50 mm based on the standard, and its heat dissipation body has a substantially hemispherical shape. Herein, the height of the heat dissipation body 418 is preferably 5 mm or more to 20 mm or less, more preferably 5 mm or more to 15 mm or less, and further more preferably 10 mm or more to 15 mm or less. Assuming that a curvature of the heat dissipation body having the substantially hemispherical shape is within the standard, for example in the case where the height of the heat dissipation body 418 is 5 mm or more to 20 mm or less, the heat dissipation body 418 covers the casing 4 such that it covers an area of 10% or more to 40% or less of the outermost diameter of the casing from the outermost diameter of the casing 4 toward the bottom 411, when the casing 4 is viewed from the base pins 61 side. Similarly, in the case where the height of the heat dissipation body 418 is 5 mm or more to 15 mm or less, the heat dissipation body 418 covers the casing 4 such that it covers an area of 10% or more to 30% or less. Further, in the case where the height of the heat dissipation body 418 is 10 mm or more to 15 mm or less, the heat dissipation body 418 covers the casing 4 such that it covers an area of 20% or more to 30% or less. That is, the heat dissipation body 418 is preferably provided to cover the casing 4 such that it covers an area of 10% or more to 40% or less of the outermost diameter of the casing from the outermost diameter of the casing 4 toward the bottom 411, more preferably provided to cover the casing 4 such that it covers an area of 10% or more to 30% or less, and further more preferably provided to cover the casing 4 such that it covers an area of 20% or more to 30% or less when the casing 4 is viewed from the base pins 61 side. Note that, the height of the heat dissipation body 418 is a total of the height of the heat dissipation body 418 and the height of the rim 417.

Figure 8:
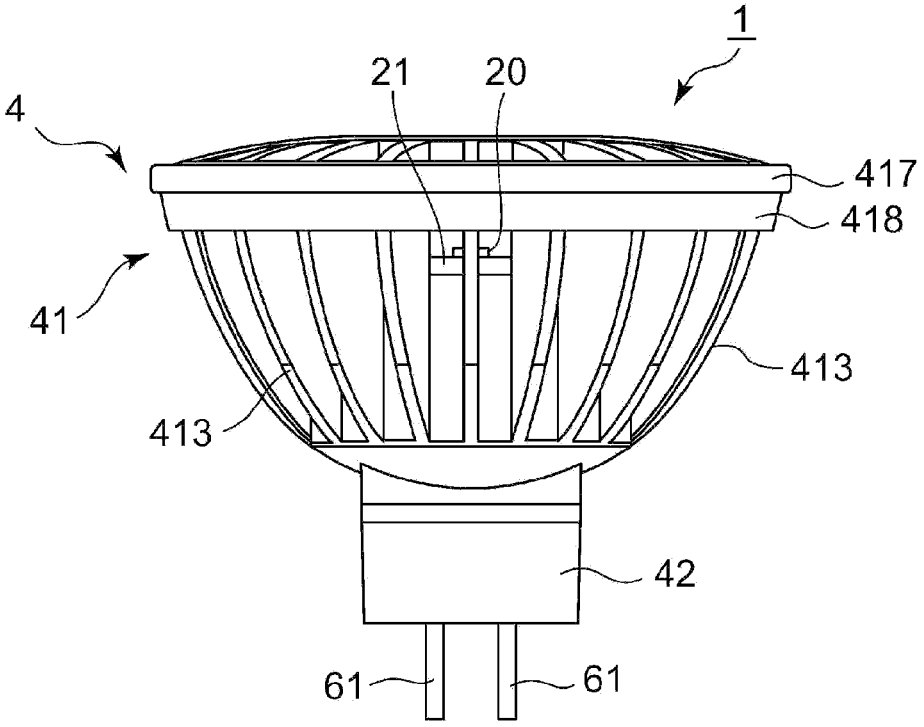
FIG. 8 is a side view of the MR16 LED lighting fixture according to this embodiment.
Figure 9:
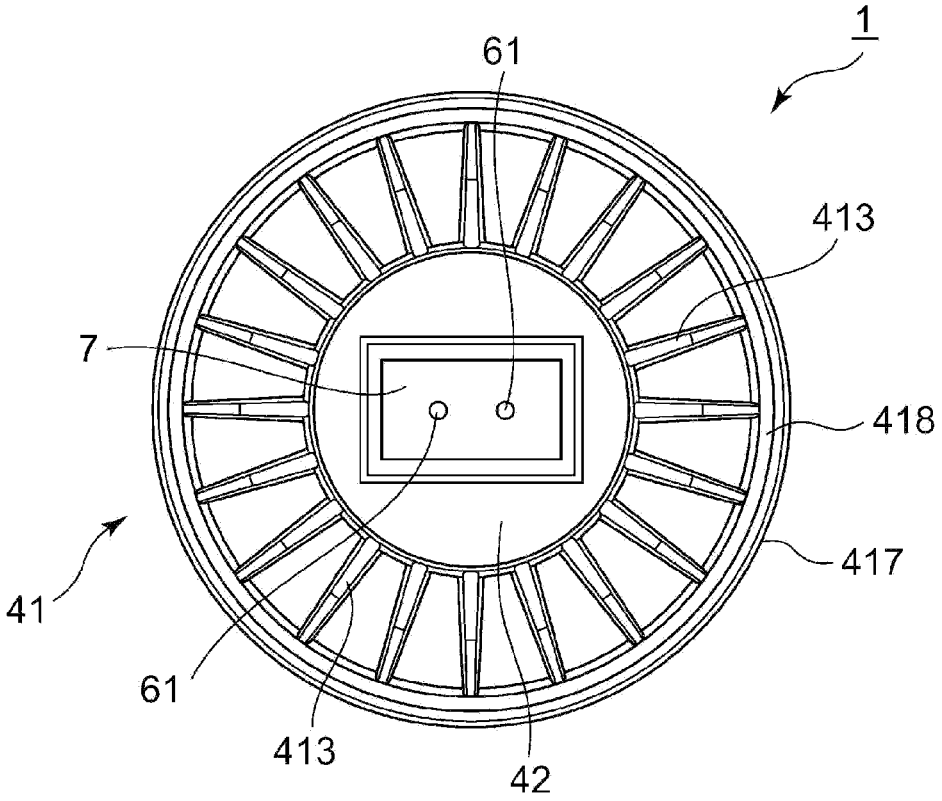
FIG. 9 is a top view of the MR16 LED lighting fixture according to this embodiment.
Figure 10:
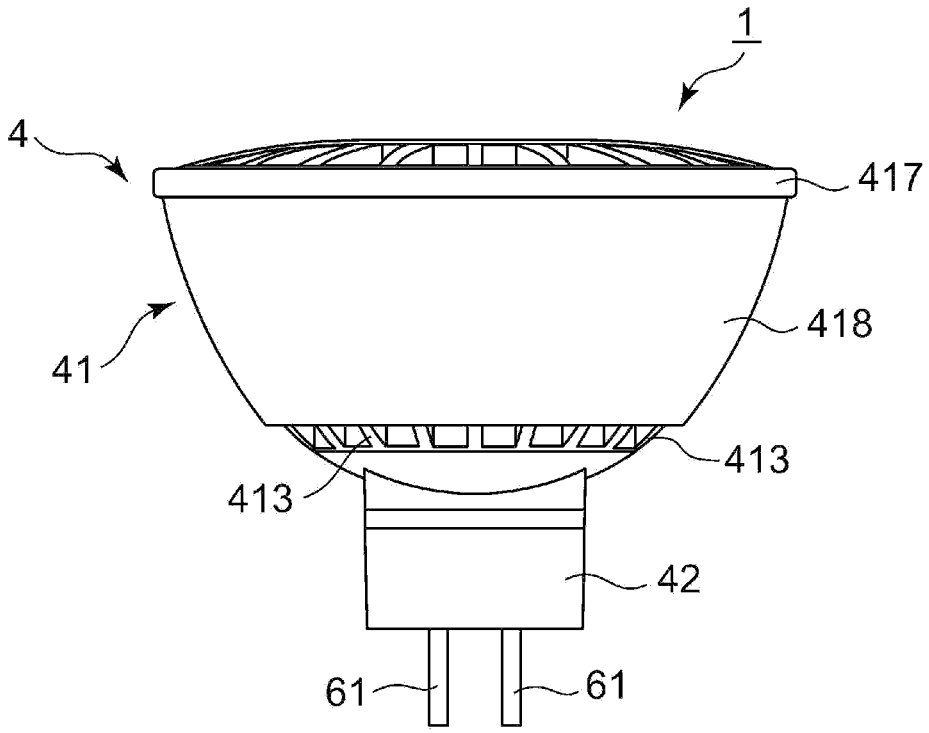
FIG. 10 is a side view of the MR16 LED lighting fixture according to this embodiment.
Figure 11:
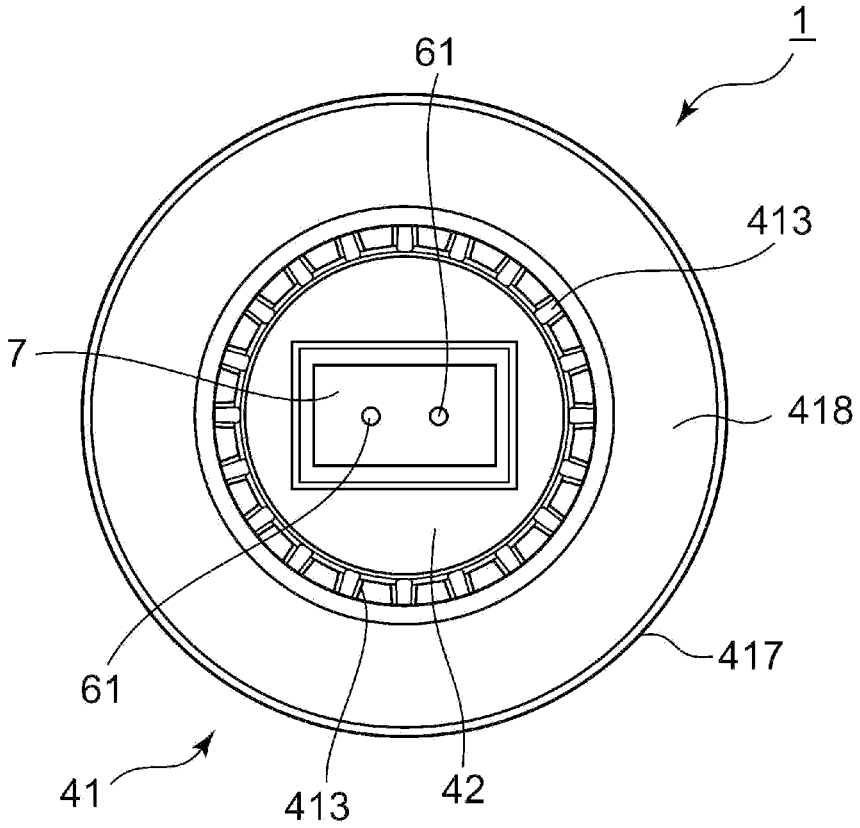
FIG. 11 is a top view of the MR16 LED lighting fixture according to this embodiment.

Note that, FIG. 6 is a side view of the MR16 LED lighting fixture 1 in the case where the height of the heat dissipation body 418 is 10 mm, and FIG. 7 is a top view of the MR16 LED lighting fixture 1 in the case where the heat dissipation body 418 covers the casing 4 such that it covers an area of about 15% from the outermost diameter of the casing 4 toward the bottom 411. Further, FIG. 8 is a side view of the MR16 LED lighting fixture 1 in the case where the height of the heat dissipation body 418 is 5 mm, and FIG. 9 is a top view of the MR16 LED lighting fixture 1 in the case where the heat dissipation body 418 covers the casing 4 such that it covers an area of about 10% from the outermost diameter of the casing 4 toward the bottom 411. Further, FIG. 10 is a side view of the MR16 LED lighting fixture 1 in the case where the height of the heat dissipation body 418 is 20 mm, and FIG. 11 is a top view of the MR16 LED lighting fixture 1 in the case where the heat dissipation body 418 covers the casing 4 such that it covers an area of about 40% from the outermost diameter of the casing 4 toward the bottom 411.

The MR16 LED lighting fixture 1 of this embodiment realizes the dissipation of the heat emitted from the LED 20 by both convection passing through gaps between the plurality of heat dissipation fins 413 and the heat dissipation body 418, and the heat radiation from the plurality of heat dissipation fins 413 and the heat dissipation body 418.

However, in the case where the heat dissipation body 418 is small in size, the heat may not be fully dissipated by the heat radiation from the heat dissipation body 418. Meanwhile, in the case where the heat dissipation body 418 is large in size, the heat may not be fully dissipated by the convection passing through the gaps between the plurality of heat dissipation fins 413 and the heat dissipation body 418 because an area of an opening through which air flows decreases.

Further, the MR16 LED lighting fixture 1 according to this embodiment has the substantially hemispherical shape such that the sectional area thereof decreases toward the base pins 61 side. Accordingly, an outside diameter of the casing 4 decreases toward the base pins 61 side, and it is possible to obtain an installation position of the heat dissipation body 418 and the height of the heat dissipation body 418 when the MR16 LED lighting fixture 1 is viewed from the top (base pins 61 side) by a curvature of an outermost diameter of the heat dissipation fins.

Herein, the MR16 LED lighting fixture 1 according to this embodiment has a smaller curvature as it approaches the center of the casing 4, and has a larger curvature as it approaches the outermost diameter of the casing 4. Therefore, in the case where the heat dissipation body 418 is provided near the center of the casing 4, the heat dissipation body 418 covers a large area of the casing 4 when the MR16 LED lighting fixture 1 is viewed from the top (base pins 61 side) even when the heat dissipation body 418 is small in size. Thereby, the area of the opening through which air flows decreases and thus the heat may not be fully dissipated by the convection passing through the gaps between the plurality of heat dissipation fins 413 and the heat dissipation body 418.

Further, in the case where the heat dissipation body 418 is provided near the center of the casing 4, since the gaps between the plurality of heat dissipation fins 413 and the heat dissipation body 418 are narrow, the heat radiated from the heat dissipation body 418 may be absorbed with the heat dissipation fins 413, or the heat radiated from the heat dissipation fin 413 may be absorbed with another heat dissipation fin 413, so that the heat may return to the inside of the casing 4. Thus, it may be difficult to make the most of the heat dissipation effect.

In order to solve these problems, in the MR16 LED lighting fixture 1 of this embodiment, the heat dissipation body 418 is provided to cover the casing 4 such that it covers a predetermined area from the outermost diameter of the casing 4 toward the bottom 411 (10% or more to 40% or less of the outermost diameter of the casing) when the casing 4 is viewed from the base pins 61 side. Thereby, the heat can be fully dissipated by the heat radiation from the heat dissipation body 418, and also the heat can be fully dissipated by the convection passing through the gaps between the plurality of heat dissipation fins 413 and the heat dissipation body 418. Further, even when the heat dissipation body 418 is large in size, the heat dissipation body 418 covers only a small area of the casing 4 when the MR16 LED lighting fixture 1 is viewed from the top (base pins 61 side). Therefore, the area of the opening through which air flows can be increased and thus the heat can be fully dissipated by the convection passing through the gaps between the plurality of heat dissipation fins 413 and the heat dissipation body 418. Further, since the gaps between the plurality of heat dissipation fins 413 and the heat dissipation body 418 are wide, the heat radiated from the heat dissipation body 418 and the heat dissipation fins 413 does not return to the inside of the casing 4 and it is possible to make the most of the heat dissipation effect. From the above, both the heat dissipation by the convection and the heat dissipation by the heat radiation, which are generated by the plurality of heat dissipation fins and the heat dissipation body, can be maximized. Further, the convection in one direction and the stable convection can be achieved. Accordingly, the heat emitted from the LED 20 can be fully dissipated, and the LED 20 can be effectively prevented from becoming a high temperature.

Further, a treatment for improving a heat radiation rate is applied to a surface of the heat sink 41. As the treatment for improving the heat radiation rate, there are various methods, such as a method of applying a surface treatment to the heat sink 41 to improve the heat radiation rate, a method of coating and forming a heat radiation rate improving film 419 on the heat sink 41, and a method of forming the heat radiation rate improving film 419 on the heat sink 41 by soaking the heat sink 41 in a heat radiation rate improving liquid. Specifically, in this embodiment, the surface of the heat sink 41 is provided with the heat radiation rate improving film 419. As the heat radiation rate improving film 419, for example, a coating material containing silicon carbide or predetermined special ceramics is preferably used. Specifically, as the heat radiation rate improving film 419, Cooltech CT-200 of Okitsumo Incorporated, or UNI cool (water-based type II) of GODO PRINTING INK MFG. CO., LTD. is preferably used. In this manner, in the MR16 LED lighting fixture 1 of this embodiment, by applying the treatment for improving the heat radiation rate to the surface of the heat sink 41, the heat dissipation by the heat radiation from the heat sink 41 can be further improved. Accordingly, the heat emitted from the LED 20 can be fully dissipated and the LED 20 can be effectively prevented from becoming a high temperature.

Note that, in this embodiment, the application of the treatment for improving the heat radiation rate is not limited to the whole surface of the heat sink 41, and the treatment for improving the heat radiation rate may be applied to only a surface of the heat dissipation body 418 of the heat sink 41. That is, the heat dissipation body 418 of the heat sink 41 may be different from the bottom 411 and the heat dissipation fins 413 in the heat radiation rate. In this manner, in the MR16 LED lighting fixture 1 of this embodiment, by applying the treatment for improving the heat radiation rate to only the surface of the heat dissipation body 418, the treatment for improving the heat radiation rate can be reduced, and the heat dissipation by the heat radiation from the heat dissipation body 418 can be further improved, as compared with the case where the treatment for improving the heat radiation rate is applied to the whole surface of the heat sink 41. Accordingly, the heat emitted from the LED 20 can be fully dissipated and the LED 20 can be effectively prevented from becoming a high temperature. Further, in the MR16 LED lighting fixture 1 of this embodiment, the heat dissipation by the heat radiation from the heat dissipation body 418 can be further improved easily without applying the treatment for improving the heat radiation rate to the plurality of heat dissipation fins 413, which is the complicated treatment.

<Simulation Result>

Figure 12:
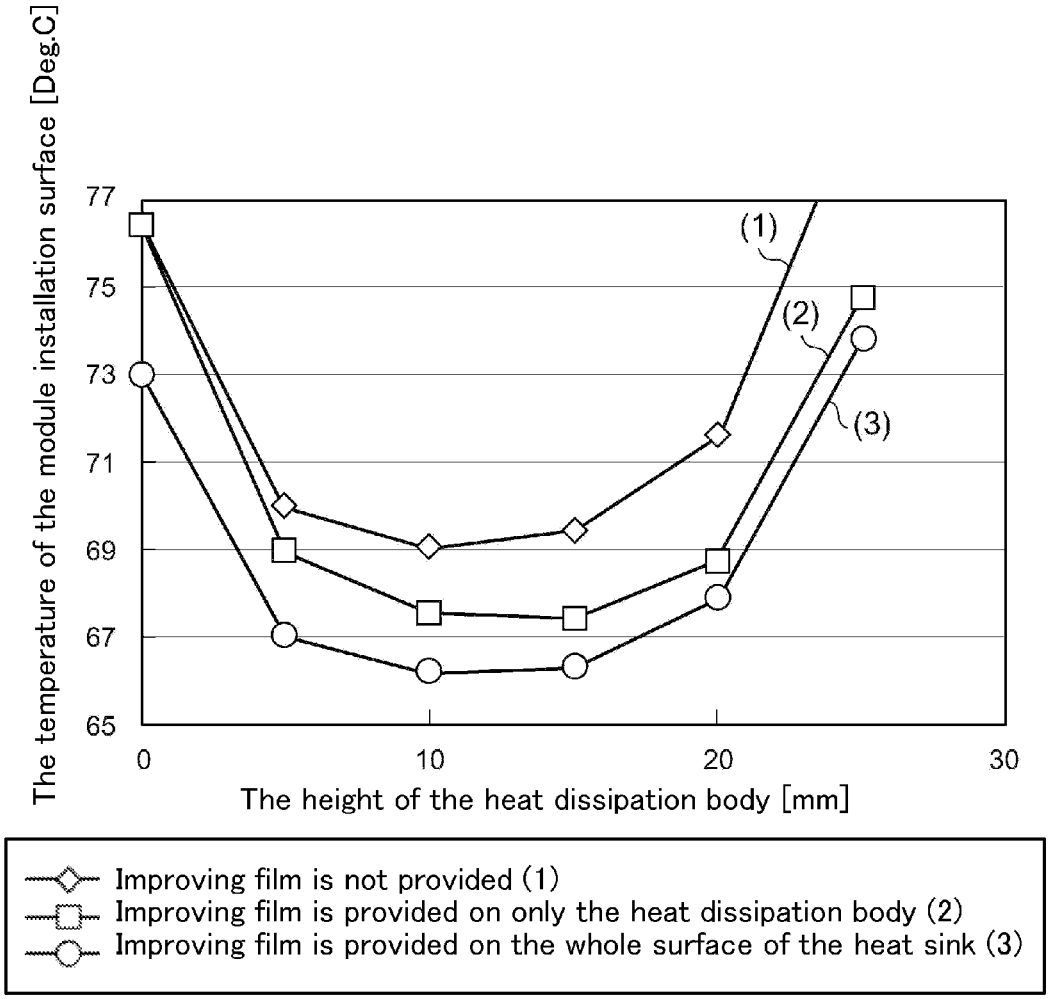
FIG. 12 is a graph illustrating a temperature of an LED light-emitting module installation surface according to this embodiment.

FIG. 12 is a graph illustrating a temperature of an LED light-emitting module installation surface according to this embodiment. In this case, a horizontal axis indicates the height of the heat dissipation body 418, and a vertical axis indicates the temperature of the module installation surface of the LED light-emitting module 2. (1) indicates a simulation result in the case where the heat radiation rate improving film 419 is not provided, (2) indicates a simulation result in the case where the heat radiation rate improving film 419 is provided on only the heat dissipation body 418, and (3) indicates a simulation result in the case where the heat radiation rate improving film 419 is provided on the whole surface of the heat sink 41. Note that, SolidWorks Flow Simulation was used as a simulator.

In this manner, in the MR16 LED lighting fixture 1 of this embodiment, by providing the heat dissipation body 418 such that it covers the predetermined area of the casing 4 from the outermost diameter of the casing 4 toward the bottom 411 (10% or more to 40% or less of the outermost diameter of the casing) when the casing 4 is viewed from the base pins 61 side, the LED 20 was effectively prevented from becoming a high temperature and the temperature of the LED light-emitting module installation surface could be remarkably lowered (FIG. 12 (1)). Further, in the MR16 LED lighting fixture 1 of this embodiment, by applying the treatment for improving the heat radiation rate to the surface of the heat sink 41, the LED 20 was effectively prevented from becoming a high temperature and the temperature of the LED light-emitting module installation surface could be remarkably lowered (FIG. 12 (33)). Further, in the MR16 LED lighting fixture 1 of this embodiment, by applying the treatment for improving the heat radiation rate to only the surface of the heat dissipation body 418, the LED 20 was effectively prevented from becoming a high temperature and the temperature of the LED light-emitting module installation surface could be remarkably lowered while reducing the treatment for improving the heat radiation rate (FIG. 12 (2)).

<Action and Effect>

As described above, in the MR16 LED lighting fixture 1 according to this embodiment, in the case where the height of the heat dissipation body 418 is 5 mm or more to 20 mm or less and the casing 4 is viewed from the base pins 61 side, the heat dissipation body 418 is provided to cover the predetermined area of the casing 4 from the outermost diameter of the casing 4 toward the bottom 411 (10% or more to 40% or less). Thereby, both the heat dissipation by the convection and the heat dissipation by the heat radiation, which are generated by the plurality of heat dissipation fins 413 and the heat dissipation body 418, can be maximized. Further, the convection in one direction and the stable convection can be achieved. Accordingly, the heat emitted from the LED 20 can be fully dissipated, and the LED 20 can be effectively prevented from becoming a high temperature.

Further, in the MR16 LED lighting fixture 1 according to this embodiment, by applying the treatment for improving the heat radiation rate to the heat sink 41, the heat dissipation by the heat radiation from the plurality of heat dissipation fins 413 and the heat dissipation body 418 can be further improved.

Further, in the MR16 LED lighting fixture 1 according to this embodiment, by applying the treatment for improving the heat radiation rate to only the surface of the heat dissipation body 418 of the heat sink 41, the treatment for improving the heat radiation rate can be reduced, and the heat dissipation by the heat radiation from the heat dissipation body 418 can be further improved.

Further, in the MR16 LED lighting fixture 1 according to this embodiment, by making the bottom 411 have the substantially circular shape, and arranging the plurality of heat dissipation fins 413 radially on the outer circumference edge of the bottom 411 and at fixed intervals on the outer circumference edge of the bottom 411, the heat dissipation by the convection generated by the plurality of heat dissipation fins 413 can be further improved.

Further, in the MR16 LED lighting fixture 1 according to this embodiment, the LED 20 is mounted on the substantial center of the board in the LED light-emitting module 2 to be disposed such that an optical axis and the center of the bottom 411 substantially correspond with each other, so that the LED light-emitting module 2 becomes the so-called one-core type and the point light source can be achieved as a whole. Accordingly, in the MR16 LED lighting fixture 1 according to this embodiment, the LED light-emitting module 2 can be downsized, and thus the plurality of heat dissipation fins 413 can be larger and the heat dissipation by the convection and the heat dissipation by the heat radiation, which are generated by the plurality of heat dissipation fins 413, can be further improved. Further, in an LED lighting fixture with which a plurality of LEDs are dotted, multiple shadows occur, which is sometimes undesirable in view of a lighting effect. In order to eliminate or reduce the multiple shadows, generally, an optical member such as a diffusion plate, or a lens is adopted or combined, or the LEDs are disposed optimally. However, in the MR16 LED lighting fixture 1 according to this embodiment, the so-called one-core type LED is used, so that the problem of the multiple shadows can be effectively eliminated or reduced.

Further, the LED chip of the LED 20 includes the GaN substrate, so that even if a current density of the LED 20 is increased, a defect is not easily generated. As a result, larger electric power for driving can be supplied to the LED 20 and light having larger luminous flux and illuminance can be emitted.

<Modification Example>

In the MR16 LED lighting fixture 1 described in this embodiment, various modifications can be made without departing from the scope of the present invention. For example, in this embodiment, the MR16 LED lighting fixture 1 is exemplified as the LED lamp meeting the existing standard, but the present invention is not limited to this, and may configure an LED lamp as a LED lighting fixture meeting other standards, such as an MR11 LED lighting fixture, an AR111 LED lighting fixture, and a PAR LED lighting fixture.

Further, in this embodiment, the description is given of the case where the standard of GU5.3 base of the MR16 LED lighting fixture 1 is adopted, but the present invention is not limited to this. The present invention can be applied to the case where the standards of other bases, such as EZ10 base are adopted, and in the case of the LED lighting fixture meeting the other standards, standards of various bases can also be applied.

Further, in this embodiment, the description is given of the case where the height of the heat dissipation body 418 is the total of the height of the heat dissipation body 418 and the height of the rim 417, but the present invention is not limited to this and, for example, the height of the heat dissipation body 418 may be the height that does not include the height of the rim 417, that is, only the height of the heat dissipation body 418.

Further, in this embodiment, the description is given of the case where the heat dissipation body 418 covers the predetermined area of the casing 4 from the outermost diameter of the casing 4 toward the bottom 411, that is, the case where the heat dissipation body 418 is configured to be along the outer shape of the casing 4, but the present invention is not limited to this and the surface area of the heat dissipation body may be larger than that in the case where the heat dissipation body is along the outer shape of the casing. For example, the heat dissipation body may have a recess and a projection in a thickness direction, may be entered into the gaps between the heat dissipation fins, or may be configured to be wavelike toward the outward direction at predetermined intervals. In this manner, by making the surface area of the heat dissipation body larger than that in the case where the heat dissipation body is along the outer shape of the casing, the surface area of the heat dissipation body can be larger and the heat dissipation by the heat radiation from the heat dissipation body can be further improved.

While the invention has been described in detail and with reference to specific embodiments thereof, it will be apparent to one skilled in the art that various changes and modifications can be made therein without departing from the spirit and scope thereof.

DESCRIPTION OF THE REFERENCE NUMERALS AND SYMBOLS

1 . . . MR
16 LED lighting fixture (LED lamp)
2 . . . LED light-emitting module
3 . . . lens module
4 . . . casing
20 . . . LED
21 . . . module board
30 . . . lens
31 . . . lens holder
41 . . . heat sink
411 . . . bottom
413 . . . heat dissipation fin
418 . . . heat dissipation body

The invention claimed is:

1. A LED lamp comprising:

an LED light-emitting module including an LED;

an lens module provided in front of the LED light-emitting module;

a casing accommodating the LED light-emitting module and having a sectional area decreasing toward a base located on a back portion of the LED lamp; and a heat sink configuring at least part of the casing and dissipating heat emitted by the LED, wherein the heat sink comprises, a bottom on which the LED light-emitting module and the lens module is installed, an outer cylinder part located on a back of the bottom, a plurality of heat dissipation fins each having a plate shape, arranged on an outer circumference edge of the bottom and extending in forward and lateral directions of the bottom, and connected to an outer circumference surface of the outer cylinder part and extending in lateral directions of the outer circumference surface, and a heat dissipation body having a beltlike shape and connecting portions on an outer circumference side of the heat dissipation fins to each other.

2. The LED lamp according to claim 1, wherein the heat dissipation body is provided to cover the casing such that the heat dissipation body covers an predetermined area of the casing from the outermost diameter of the casing toward the bottom when the casing is viewed from a base side.

3. The LED lamp according to claim 1, wherein at least part of the heat dissipation body is extended forward from the bottom.

4. The LED lamp according to claim 1, wherein the heat dissipation body is provided to cover the casing such that the heat dissipation body covers an area of 10% or more to 40% or less of an outermost diameter of the casing from the outermost diameter of the casing toward the bottom when the casing is viewed from a base side.

5. The LED lamp according to claim 1, wherein the bottom has a substantially cylindrical shape, and at least part of the plurality of heat dissipation fins are arranged radially on the outer circumference edge of the bottom.

6. The LED lamp according to claim 1, wherein a treatment for improving a heat radiation rate is applied to each of the bottom, the heat dissipation fins, and the heat dissipation body of the heat sink.

7. The LED lamp according to claim 6, wherein a heat radiation rate improving film for improving the heat radiation rate is provided on each of the bottom, the heat dissipation fins, and the heat dissipation body of the heat sink.

8. The LED lamp according to claim 1, wherein the LED lamp is an MR16 LED lighting fixture, an MR11 LED lighting fixture, an AR111 LED lighting fixture or a PAR LED lighting fixture.

9. The LED lamp according to claim 1, wherein the LED lamp has a shape and a size replaceable with an MR16 halogen bulb, and the heat dissipation body has a height of 5 mm or more to 20 mm or less.

10. The LED lamp according to claim 1, wherein the heat dissipation body of the heat sink is different from the bottom and the heat dissipation fins in the heat radiation rate.

11. The LED lamp according to claim 1, wherein a surface area of the heat dissipation body is larger than a surface area of the heat dissipation body in the case where the heat dissipation body is along an outer shape of the casing.

12. The LED lamp according to claim 1, wherein at least part of the plurality of heat dissipation fins are arranged at fixed intervals on the outer circumference edge of the bottom.

13. The LED lamp according to claim 1, wherein in the LED light-emitting module, the LED is mounted on a substantial center of a board to be disposed such that an optical axis of the LED and a center of the bottom substantially correspond with each other.

14. The LED lamp according to claim 1, wherein an LED chip of the LED includes a GaN substrate.

* * * * *